US006540301B1

(12) United States Patent
Bottoms

(10) Patent No.: US 6,540,301 B1
(45) Date of Patent: Apr. 1, 2003

(54) BODY SUPPORT FOR AUTOMOTIVE MECHANICS

(75) Inventor: Gary D. Bottoms, Fort Mill, SC (US)

(73) Assignee: Auto Products, Inc., Fort Mill, SC (US)

( * ) Notice: Subject to any disclaimer, the term of this patent is extended or adjusted under 35 U.S.C. 154(b) by 0 days.

(21) Appl. No.: 09/599,670

(22) Filed: Jun. 22, 2000

Related U.S. Application Data

(60) Provisional application No. 60/140,668, filed on Jun. 24, 1999.

(51) Int. Cl.[7] ..... A47C 7/50

(52) U.S. Cl. ..... 297/423.11; 297/423.12; 297/423.13; 297/338; 297/451.3; 135/66; 135/65; 182/115; 182/116; 182/129

(58) Field of Search ..... 182/115, 116, 182/129; 297/423.11, 423.12, 423.13, 338, 451.3; 135/66, 65

(56) References Cited

U.S. PATENT DOCUMENTS

| | | | | | |
|---|---|---|---|---|---|
| 2,701,168 | A | * | 2/1955 | Schemers | 182/115 |
| 2,872,252 | A | * | 2/1959 | Konkle | 182/115 |
| 2,969,123 | A | * | 1/1961 | Jamerson et al. | 182/152 |
| 3,863,978 | A | * | 2/1975 | Gillings, Jr. | 297/439 |
| 3,976,155 | A | * | 8/1976 | Esch | 280/32.5 |
| 4,072,209 | A | * | 2/1978 | Bolis | 182/116 |
| 4,109,961 | A | * | 8/1978 | Opsvik | 297/338 |
| 4,397,374 | A | | 8/1983 | Rumage et al. | |
| 4,542,806 | A | * | 9/1985 | Olson | 182/152 |
| 4,650,249 | A | * | 3/1987 | Seber | 297/313 |
| 4,653,808 | A | * | 3/1987 | Opsvik | 297/423 |
| 4,690,459 | A | * | 9/1987 | Ulman | 297/458 |
| 4,800,987 | A | | 1/1989 | Liles | |
| 5,029,671 | A | | 7/1991 | Larson | |
| 5,072,955 | A | | 12/1991 | Holland et al. | |
| 5,099,951 | A | | 3/1992 | Stockwell | |
| 5,167,436 | A | * | 12/1992 | Wu | 297/338 |
| 5,600,857 | A | * | 2/1997 | Heilmann | 5/86.1 |
| 5,669,669 | A | * | 9/1997 | Usher | 297/423.12 |
| 6,017,089 | A | * | 1/2000 | Mengshoel | 297/338 |
| 6,105,719 | A | * | 8/2000 | Lensing | 182/116 |

OTHER PUBLICATIONS

"Topside Creeper"; Rel Products; Entire Brochure; Published prior to Jun. 24, 1999.

"Automotive Creepers, Seats & More"; Published prior to Jun. 24, 1999.

* cited by examiner

*Primary Examiner*—Carl D. Friedman
*Assistant Examiner*—Dennis L. Dorsey
(74) *Attorney, Agent, or Firm*—Adams, Schwartz & Evans, P.A.

(57) ABSTRACT

A mechanic's body support including first and second horizontally-oriented and spaced-apart base rails and first and second spaced-apart support rails. Each of the support rails has one end connected to a respective one of the first and second base rails and diverging upwardly from and along the length of the base rails for supporting a mechanic in an elevated position over the engine compartment of a motor vehicle. A chest pad and a knee pad are mounted in spaced-apart relation between the support rails for securing the support rails in a fixed, spaced-apart relation, and for supporting the chest and knees of the mechanic.

15 Claims, 18 Drawing Sheets

BODY SUPPORT FOR AUTOMOTIVE MECHANICS

This application relates to U.S. Provisional Patent Application Serial No. 60/140,668, filed on Jun. 24, 1999, and claims priority to that provisional application.

TECHNICAL FIELD AND BACKGROUND OF INVENTION

This invention relates to a body support for mechanics. While the preferred embodiments disclosed herein are of body supports for providing support to mechanics as they repair motor vehicles, the body support of the present invention could clearly be used in any environment where an individual finds it necessary to lean over the equipment, object or project upon which the individual is working, including those involving the provision of medical or veterinary services. Although the vehicle referred to throughout this application is a motor vehicle, it is understood that the invention relates as well to other types of vehicles or equipment including but not limited to airplanes, boats, or other heavy machinery.

In many instances, an automotive mechanic working in an automotive repair shop requires an apparatus to lean against or kneel upon which provides more physical support as he leans over engine compartment of a motor vehicle to inspect and/or repair the components located therein. Using an such an apparatus not only enhances the overall comfort of the mechanic as he works, but ultimately increases his productivity. In addition, without sufficient lumbar and thoracic support, an automotive mechanic who repeatedly bends over an engine compartment is also at increased risk for spinal injuries, which are often accompanied by neurological and orthopedic complications. While body supports for mechanics are available, such supports lack features for maximizing the comfort of the mechanic while maintaining the stability of the support. Such supports also do not provide proper leverage to the mechanic when the support is used in both front-of-vehicle and side-of-vehicle positions.

The invention of the present application provides an effective solution for providing increased comfort to mechanics, improving overall productivity and decreasing the risk of injuries resulting from working over an engine compartment without using adequate supplementary support. The mechanic's body support takes advantage of a chest pad and knee pad which provide enhanced support to the chest and knees of a mechanic as he works on the engine of a motor vehicle. Additional embodiments of the invention provide not only means for adjusting the chest and knee pads, but also for adjusting the rails upon which these pads are attached, which further enhances the overall support provided to the mechanic.

SUMMARY OF THE INVENTION

Therefore, it is an object of the invention to provide a body support for automotive mechanics that maximizes the physical comfort of a mechanic as he leans over the engine compartment of a vehicle.

It is another object of the invention to provide a body support for automotive mechanics that maximizes the leverage available to a mechanic as he leans over the engine compartment of a vehicle.

It is another object of the invention to provide a body support for automotive mechanics that can be adjusted for increased stability as necessary.

It is another object of the invention to provide a body support for automotive mechanics that may be used either in front of a vehicle or to the side of a vehicle.

It is another object of the invention to provide a body support for automotive mechanics that can be conveniently adapted for use with vehicles of various sizes.

It is another object of the invention to provide a body support for automotive mechanics that allows for the attachment of accessories such as a tool tray or a magnetic bolt table.

These and other objects of the present invention are achieved in the preferred embodiments disclosed below by providing a mechanic's body support for providing support to a mechanic during repair of a motor vehicle comprising first and second horizontally-oriented and spaced-apart base rails, and first and second spaced-apart support rails. Each of the support rails has one end connected to a respective one of the first and second base rails and diverges upwardly from and along the length of the base rails for supporting the mechanic in an elevated position over the engine compartment of the motor vehicle. The mechanic's body support also includes a chest pad and a knee pad mounted in spaced-apart relation between the support rails for securing the support rails in a fixed, spaced-apart relation, and for supporting the chest and knees of the mechanic.

According to one preferred embodiment of the invention, the mechanic's body support includes height adjustment means adapted for selectively mounting the knee pad in one of at least two vertical positions relative to the support rails.

According to another preferred embodiment of the invention, the height adjustment means comprises first and second vertically-spaced notches, and the knee pad includes a complementary tooth thereon for cooperating with a respective one of the first and second notches.

According to another preferred embodiment of the invention, the notch and complementary tooth are each shaped whereby the tooth is wedged into the notch in response to downward pressure on the knee pad.

According to another preferred embodiment of the invention, each of the support rails is formed of two separable support rail segments and includes length adjusting means for permitting the length the support rail to be adjusted by movement of respective support rail segments relative to each other.

According to another preferred embodiment of the invention, the length adjusting means comprise a keyway on one of the support rail segments, and a complementary post on the other of the support rail segments for cooperating with the keyway for releasably locking the two support rail segments together.

According to another preferred embodiment of the invention, each of the support rails includes an upper rail segment and a lower rail segment. The upper rail segment is rotatably connected to the lower rail segment by rotatable locking means for permitting limited movement of the upper rail segment through an arc for adjusting the pitch of the chest pad.

The rotatable locking means preferably comprises a pair of releasably-locking hub gears.

According to another preferred embodiment of the invention, the height adjustment means comprises a plurality of vertically-spaced openings defined by each support rail. Each of the openings is adapted for receiving and releasably locking a complementary slide on the knee pad therein. The knee pad includes a complementary slide thereon for being received into a selected one of the openings.

According to another preferred embodiment of the invention, the height adjustment means comprises a vertically-oriented slot extending through each of the support rails and adapted for receiving a pin inserted therethrough, and a complementary hole defined in a side of the knee pad adapted for receiving the pin therein for releasably locking the knee pad into a selected one of a plurality of vertical positions.

According to another preferred embodiment of the invention, the lower rail segment comprises first and second elongate tubular rails. Each of the tubular rails has respective first and second ends, and the respective first ends of the first and second tubular rails are connected to a respective one of the first and second base rails. The respective second ends of the first and second tubular rails are connected together by and integrally formed with a U-shaped tubular member.

According to another preferred embodiment of the invention, the chest pad includes a U-shaped channel adapted for receiving a U-shaped tubular rail therein, and the upper rail segment comprises a complementary U-shaped tubular rail for cooperating with the U-shaped channel for attaching the knee pad to the upper rail segment.

According to another preferred embodiment of the invention, the rotatable locking means comprises a first plate connected between the first and second tubular rails and having a first hole defined therethrough, and a second plate connected to the upper rail segment and having a series of second holes defined therethrough at spaced-apart intervals to form an arc. A locking pin is adapted for being inserted through the first hole, through a selected one of said second holes and into a opening defined in an end of the U-shaped tubular rail.

According to another preferred embodiment of the invention, the height adjusting means includes pivot means comprising a third plate connected between the first and second tubular rails. The third plate is adapted for permitting limited pivotal movement of the knee pad through an arc and locking the knee pad in a limited number of predetermined positions, thereby adjusting the angle of the knee pad relative to the support rails.

According to another preferred embodiment of the invention, the mechanic's body support includes first and second wheels positioned on the respective first and second base rails for permitting the body support to roll as it is being moved.

According to yet another preferred embodiment of the invention, a mechanic's body support for providing support to a mechanic during repair of a motor vehicle is provided. The body support includes a curved beam having a longitudinally-oriented upper end and a horizontally-oriented lower end. A pair of floor-engaging, laterally-extending feet are attached in spaced-apart relation along the lower end for supporting said body support in an upright position. A chest pad is mounted on the upper end for supporting the chest and upper torso of the mechanic, and a knee pad is mounted intermediate with the chest pad and the pair of feet for supporting the knees of the mechanic.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
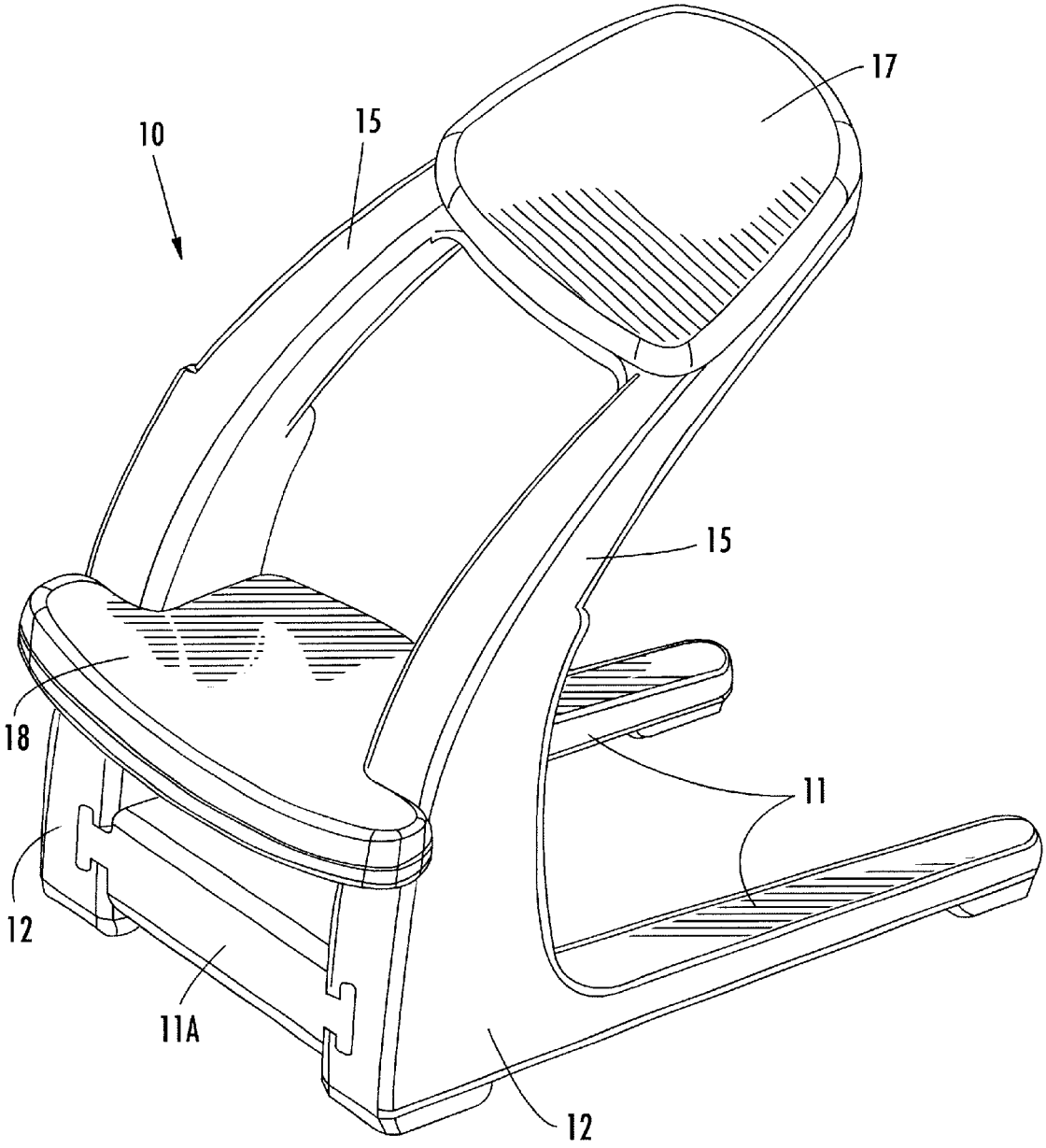
FIG. 1 is a perspective view of a mechanic's body support according to one embodiment of the invention.

Referring now specifically to the drawings, a mechanic's body support according to one preferred embodiment of the present invention is illustrated in FIG. 1 and shown generally at reference numeral 10. The body support 10 includes first and second horizontally-oriented base rails 11, having respective ends 12 integrally formed with respective first and second support rails 15. Connecting each of the support rails 15 to a respective base rail 11 in this manner permits each support rail 15 to diverge upwardly away from the base rail 11 for permitting the body support 10 to be conveniently positioned either in front or to the side of the engine compartment of a motor vehicle. This allows a mechanic using the body support 10 to lean against the body support 10 for support and position himself over the engine compartment. A cross bar 11A is mounted between the base rails 11 for providing supplemental reinforcement to the body support 10.

As is shown in FIG. 1, the body support 10 also includes a cushioned chest pad 17 and a cushioned knee pad 18, which are mounted between the support rails 15. The chest pad 17 is for supporting and cushioning the chest of the mechanic, and the knee pad 18 is for supporting the knees of the mechanic. While the chest pad 17 and knee pad 18 may be mounted at any point along the support rails 15, the chest pad 17 and knee pad 18 are preferably spaced apart along the support rails 15 at a distance sufficient to permit a mechanic to comfortably lean his chest against the chest pad 17 and kneel upon the knee pad 18 without having the chest pad 17 extend past his shoulders and into his neck region. Together, the chest pad 17 and knee pad 18 provide comfort to the mechanic and secure the support rails 15 in spaced-apart relation, thereby helping to reduce the incidence of back pain or other injuries the mechanic might otherwise experience if he were to work using inadequate supplemental body support, or no supplemental body support at all.

The base rails 11 and support rails 15 are preferably formed from a durable metal such as aluminum or a high density plastic such as polyethylene or polypropylene. Although the chest pad 17 may be any shape or size, the chest pad 17 preferably has a flat, padded surface. The knee pad 18 may likewise be any shape or size; however the knee pad 18 preferably has a flat, padded surface. Although any suitable material may be used, the chest pad 17 and knee pad 18 are each preferably cushioned by a layer of high density, closed-cell foam padding.

Figure 2:
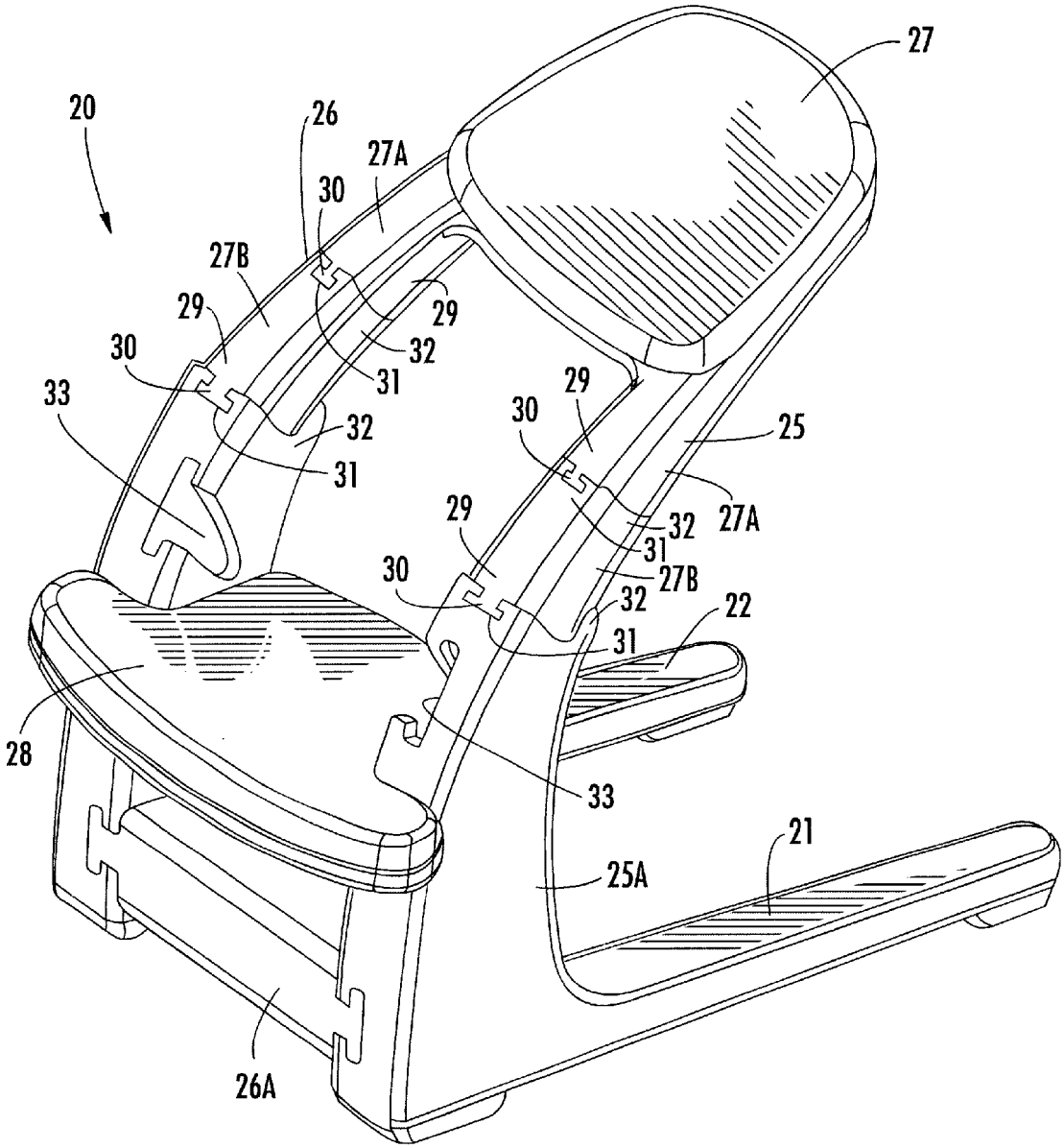
FIG. 2 is a perspective view of a mechanic's body support according to another embodiment of the invention.

Referring now to FIG. 2, a mechanic's support according to another preferred embodiment of the invention is illustrated and shown generally at reference numeral 20. The body support 20 includes first and second horizontally-oriented base rails 21 and 22 connected to respective first and second support rails 25 and 26. A cross bar 26A is mounted between the base rails 21 and 22 for providing supplemental reinforcement to the body support 20. The body support 20 also includes a chest pad 27 mounted between the respective support rails 25 and 26 for providing support and cushioning to the chest of a mechanic as he leans thereon. A knee pad 28 is mounted between respective support rails 25 and 26 below the chest pad 27 for supporting the knees of the mechanic thereon.

Figure 3:
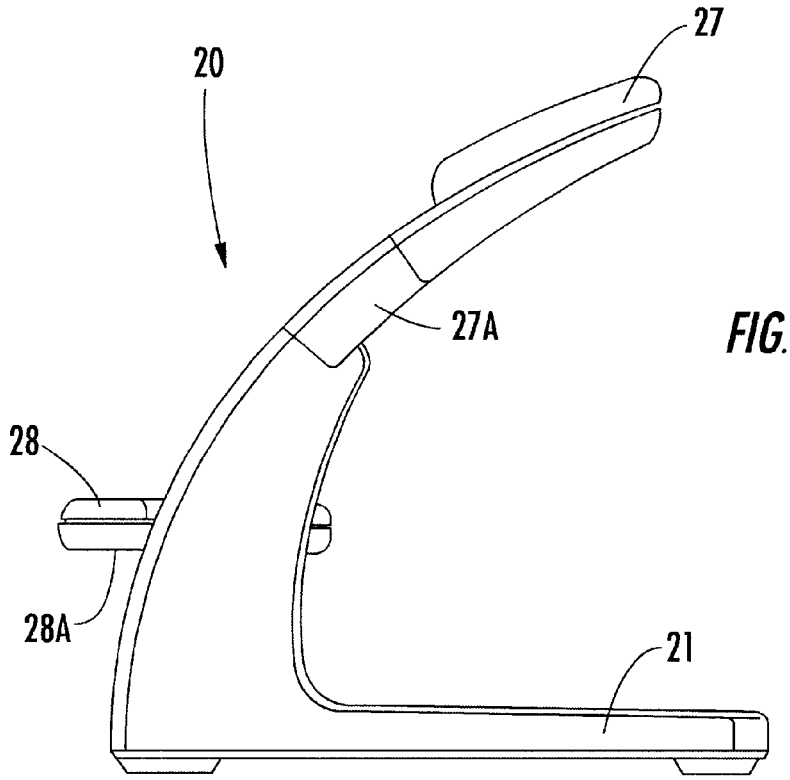
FIG. 3 is a side view of the mechanic's body support shown in FIG. 2.

Unlike the support rails 15 of the body support 10 shown in FIG. 1, the length of respective support rails 25 and 26 is adjustable. Each support rail 25 and 26 is formed from two support rail segments 27A and 27B, each of which includes a first end 29 having a post 30 thereon adapted for cooperating with a complementary keyway 31, which is integrally formed with a second end 32. The complementary post 30 and keyway 31 cooperate with one another for permitting respective first and second ends 29 and 32 to be releasably locked together. FIG. 3 shows a side view of the base support 20.

Figure 4:
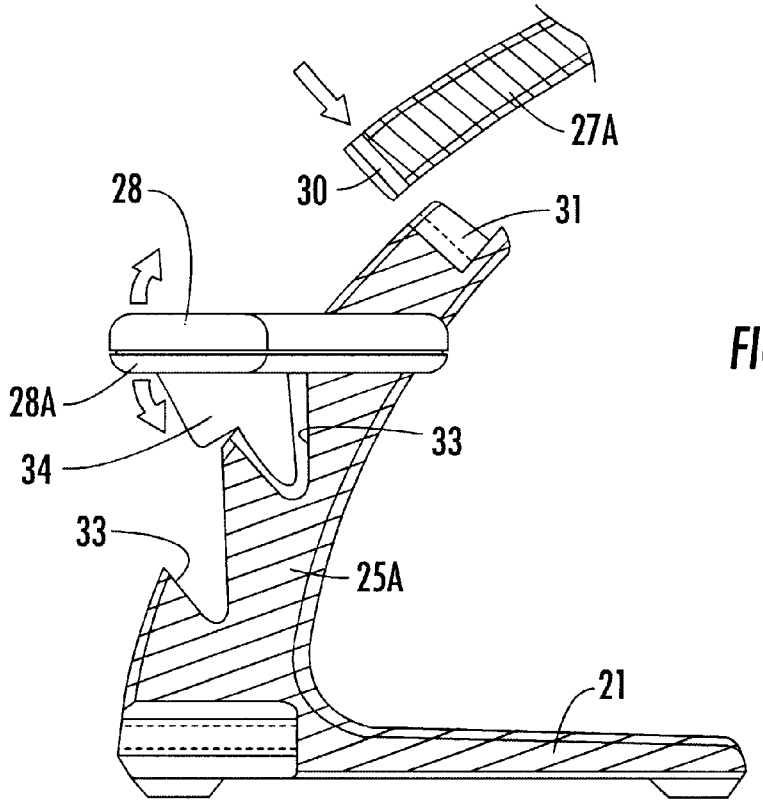
FIG. 4 is a cut-away side view of the mechanic's body support shown in FIGS. 2 and 3.

As is shown in FIGS. 2 and 4, the vertical height of the knee pad 28 may also be adjusted. Support rails 25 and 26 include respective lower ends 25A and 26B, each of which includes two vertically-spaced notches 33 integrally formed therein. FIG. 2 shows two notches 33 positioned along lower end 26B: the two notches 33 positioned along lower end 25A are not shown. As is shown in FIG. 4, the knee pad 28 includes a bottom 28A having a complementary tooth 34 positioned thereon, which is adapted for cooperating with any one of the notches 33. While the notches 33 and tooth 34 may be of any shape or size, the notches 33 and the tooth 34 are preferably shaped such that when the tooth 34 is placed in one of the notches 33, the tooth 34 becomes wedged into the notch 33 in response to the mechanic placing his knees on the knee pad 20, which in turn places downward pressure on the tooth 34. Should the mechanic wish to change the height of the knee pad 28, the tooth 34 is lifted from the corresponding pair of notches 33, and the tooth 34 is repositioned in a second pair of notches 33 along the lower ends 25A and 26B of respective support rails 25 and 26.

Figure 5:
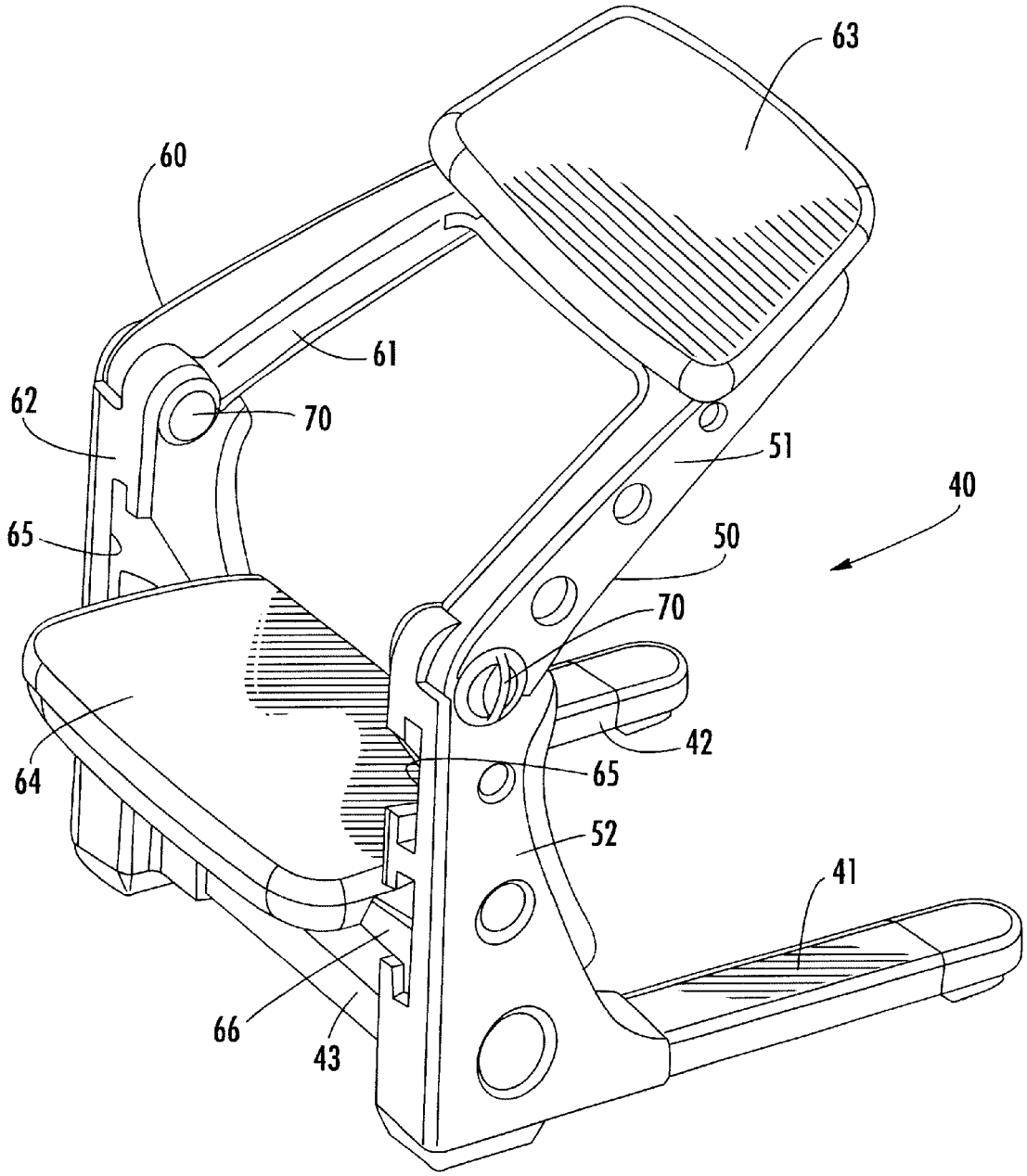
FIG. 5 is a perspective view of a mechanic's body support according to another embodiment of the invention.

Referring now to FIG. 5, a mechanic's body support according to another preferred embodiment of the invention is illustrated and shown generally at reference numeral 40. The body support 40 includes first and second horizontally-oriented base rails 41 and 42 connected to respective first and second support rails 50 and 60. A cross bar 43 is mounted between the base rails 21 and 22 for providing supplemental reinforcement to the body support 20. The respective support rails 50 and 60 each include respective upper support rail segments 51 and 61 rotatably connected by a pivot 70 to respective lower support rail segments 52 and 62 for permitting upper support rail segments 51 and 61 to pivotally move through an arc, thereby giving the support rails 50 and 60 a range of adjustment. The body support 40 also includes a chest pad 63 mounted between the respective upper rail segments 50 and 60 for providing support and cushioning to the chest of a mechanic as he leans thereon.

Figure 6:
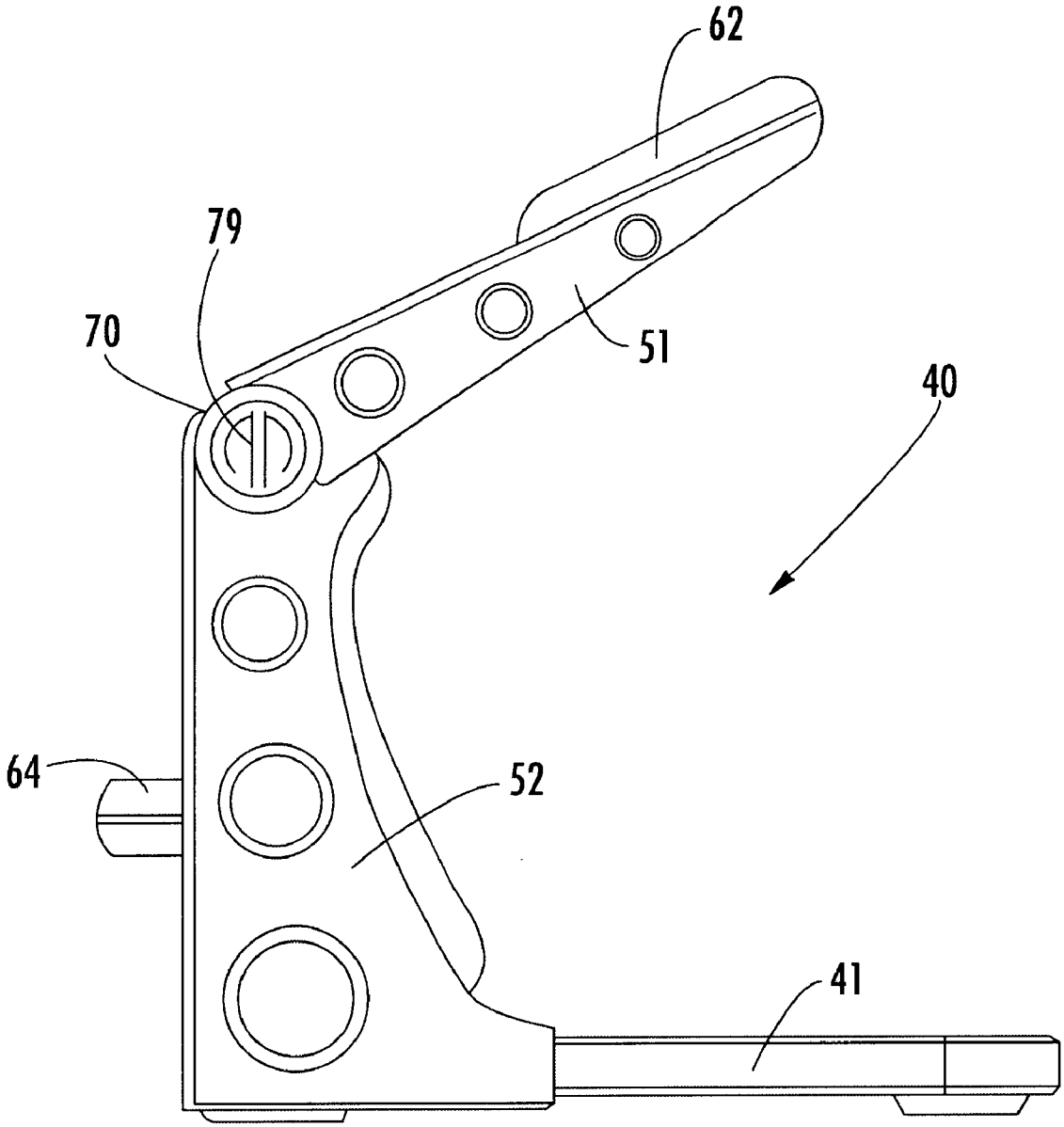
FIG. 6 is a side view elevation of the mechanic's body support shown in FIG. 5.

As is shown in FIG. 5, the body support 40 also includes a knee pad 64 mounted between respective lower support rail segments 52 and 62 for supporting the knees of the mechanic thereon. Like the knee pad 28 of body support 20, the vertical height of the knee pad 64 may also be adjusted, however, a different adjustment mechanism is employed. Each of the lower support rail segments 52 and 62 includes a series of spaced-apart, notched openings 65 formed therein. Each opening 65 is adapted for receiving one of a pair of complementary slides 66 therein. Each slide 66 is attached to opposite sides of the knee pad 64, thereby positioning the slide 66 for cooperating with any one of the paired openings 65 for changing the height of the knee pad 64. FIG. 5 shows one slide 66 attached to a side of the knee pad 64 and acting in cooperation with an opening 65 defined in lower support rail segment 62. The slide 66 attached to the other side of the knee pad 64 is not shown. FIG. 6 shows a side view of the body support 40.

Figure 7:
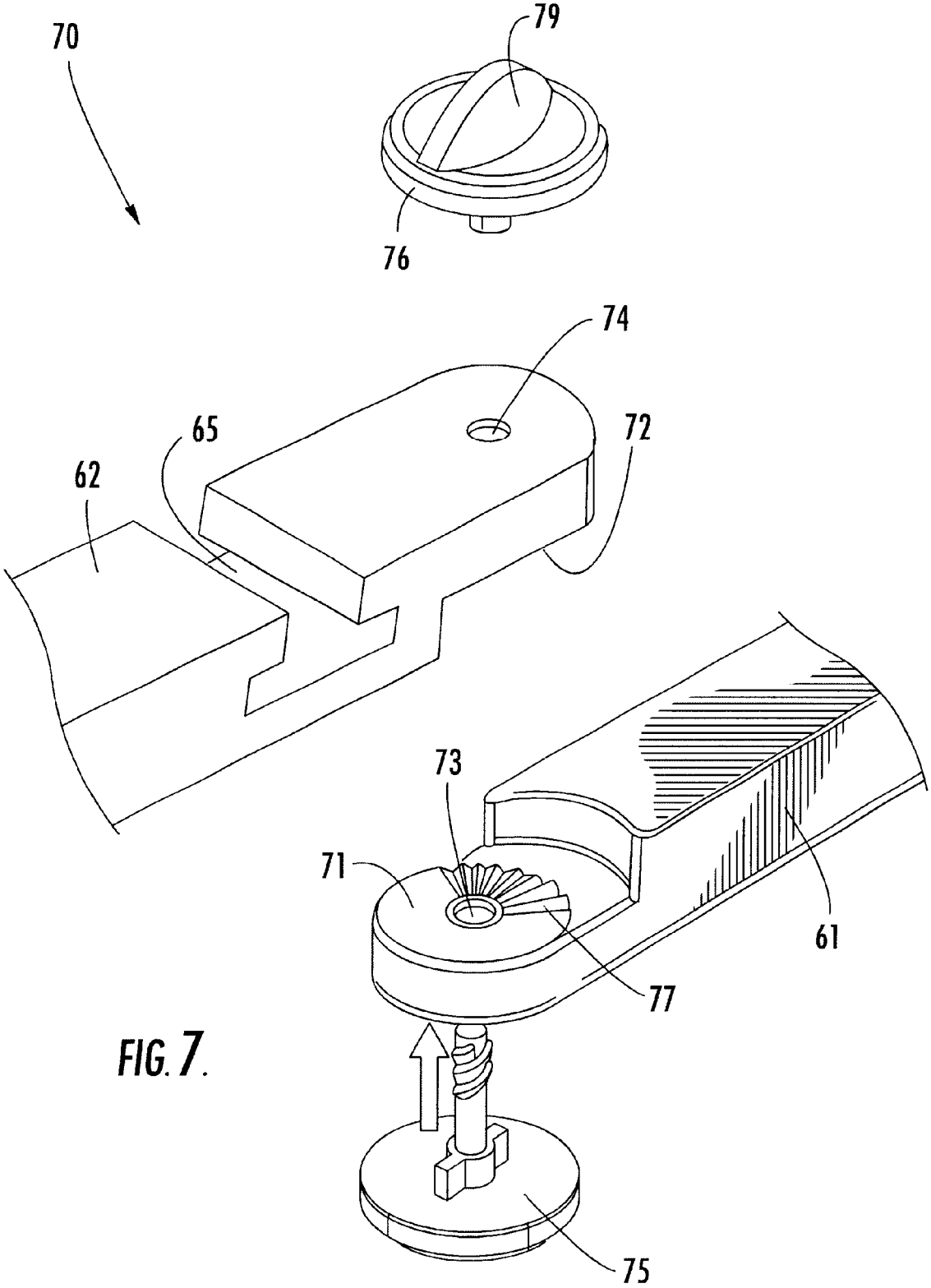
FIG. 7 is an exploded perspective view of the chest support adjustment arm assembly of the mechanic's body support shown in FIGS. 5 and 6.
Figure 8:
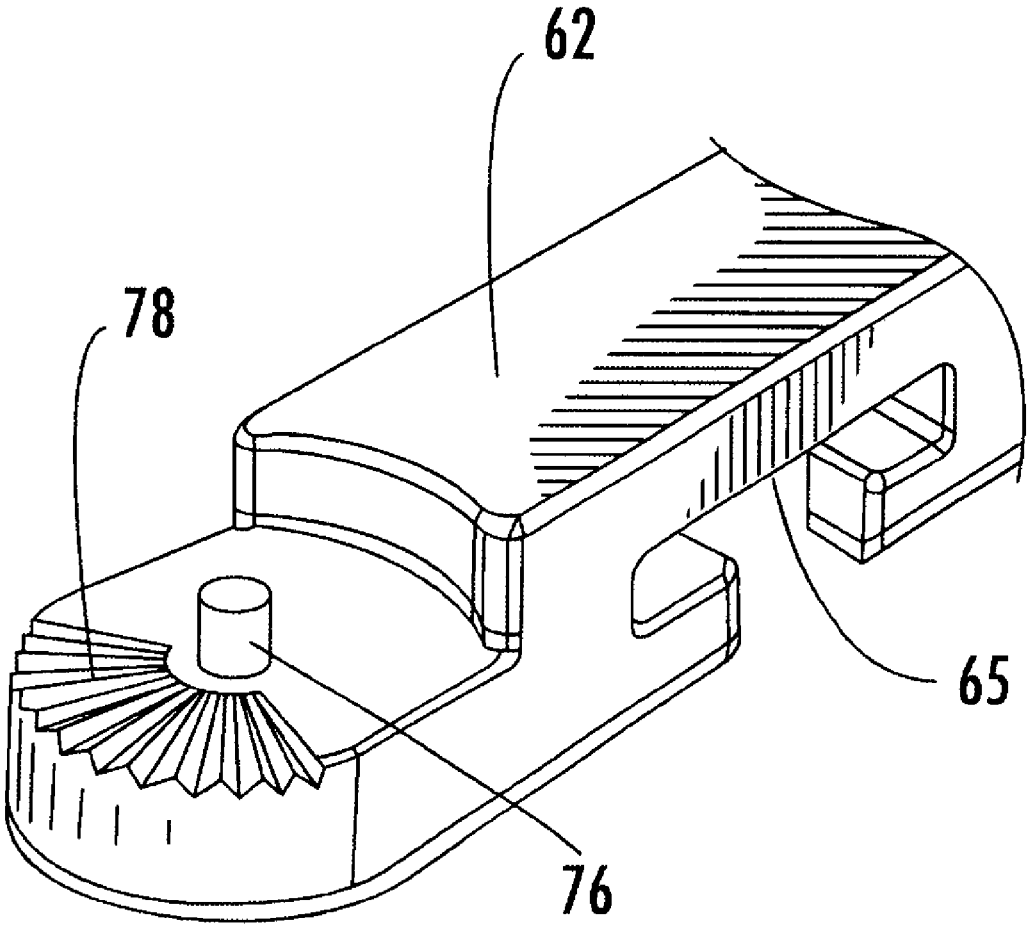
FIG. 8 is a perspective view of the underside of one of the adjustment arms shown in FIG. 7.

Referring now to FIGS. 7 and 8, a detailed view of pivot 70 is shown prior to assembly. As is shown in FIG. 7, pivot 70 includes complementary locking hubs 71 and 72, which are formed in the ends of upper support rail segment 61 and lower support rail segment 62, respectively. Hubs 71 and 72 have respective holes 73 and 74 extending therethrough for receiving a screw 75 a nut 76 respectively. Respective radially-extending teeth 77 and 78 are formed on facing surfaces of hubs 71 and 72 around the periphery of holes 73 and 74. Teeth 77 and 78 interlock when the screw 75 and nut 76 are tightened together, thereby releasably locking the upper support rail segment 61 and lower support rail segment 62 together at a desired relative position. Screw 75 and nut 76 each include an enlarged head 79 for increasing the torque applied on the pivot 70 during assembly. The head 79 of screw 75 is shown in FIG. 6. Lower support rail segment 51 and upper support rail segment 52 are likewise releasably locked together by a pivot 70, which includes components identical to those shown in FIGS. 7 and 8, but is not shown.

Figure 9:
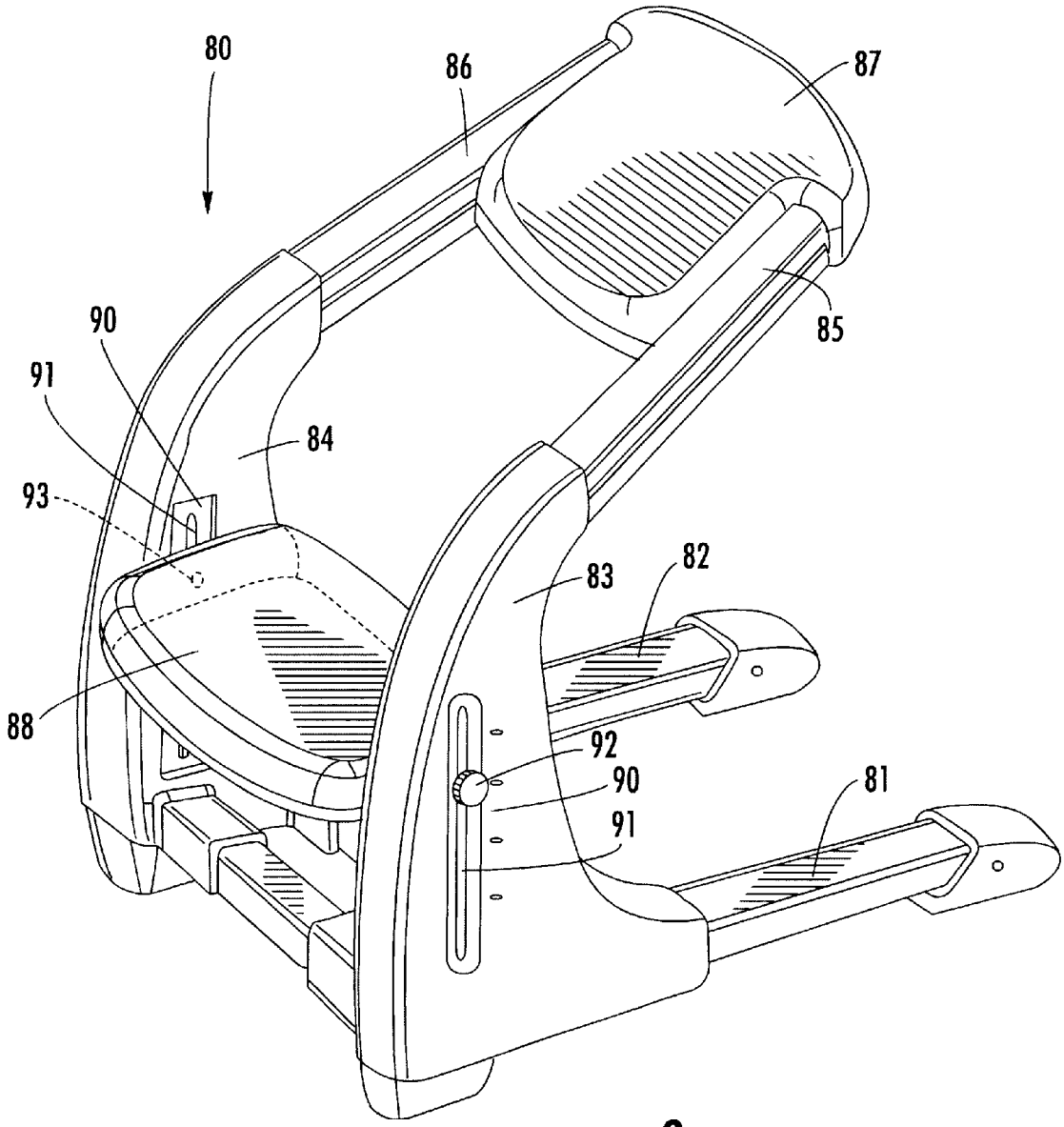
FIG. 9 is a perspective view of a mechanic's body support according to another embodiment of the invention.

Referring now to FIG. 9, a mechanic's body support according to another embodiment of the invention is shown generally at reference numeral 80. The body support 80 includes first and second horizontally-oriented base rails 81 and 82, respectively, connected to respective lower support rail segments 83 and 84, which are attached to respective upper support rails 85 and 86. A chest pad 87 is mounted between respective upper support rails 85 and 86 for supporting the chest of a mechanic as he leans thereon to work on the engine of a motor vehicle. The body support 80 also includes a knee pad 88, which is attached between respective lower support rail segments 83 and 84 by a height-adjusting mechanism 90. Each height adjusting mechanism 90 includes a vertically-oriented slot 91 which extends through lower support rail segments 83 and 84, respectively. Each slot 91 is adapted for receiving a complementary pin 92 therethrough, which extends through the respective lower support rail segment 83 or 84 and into a complementary hole 93 (shown drawn in phantom) defined in the side of the knee pad 88.

Figure 10:
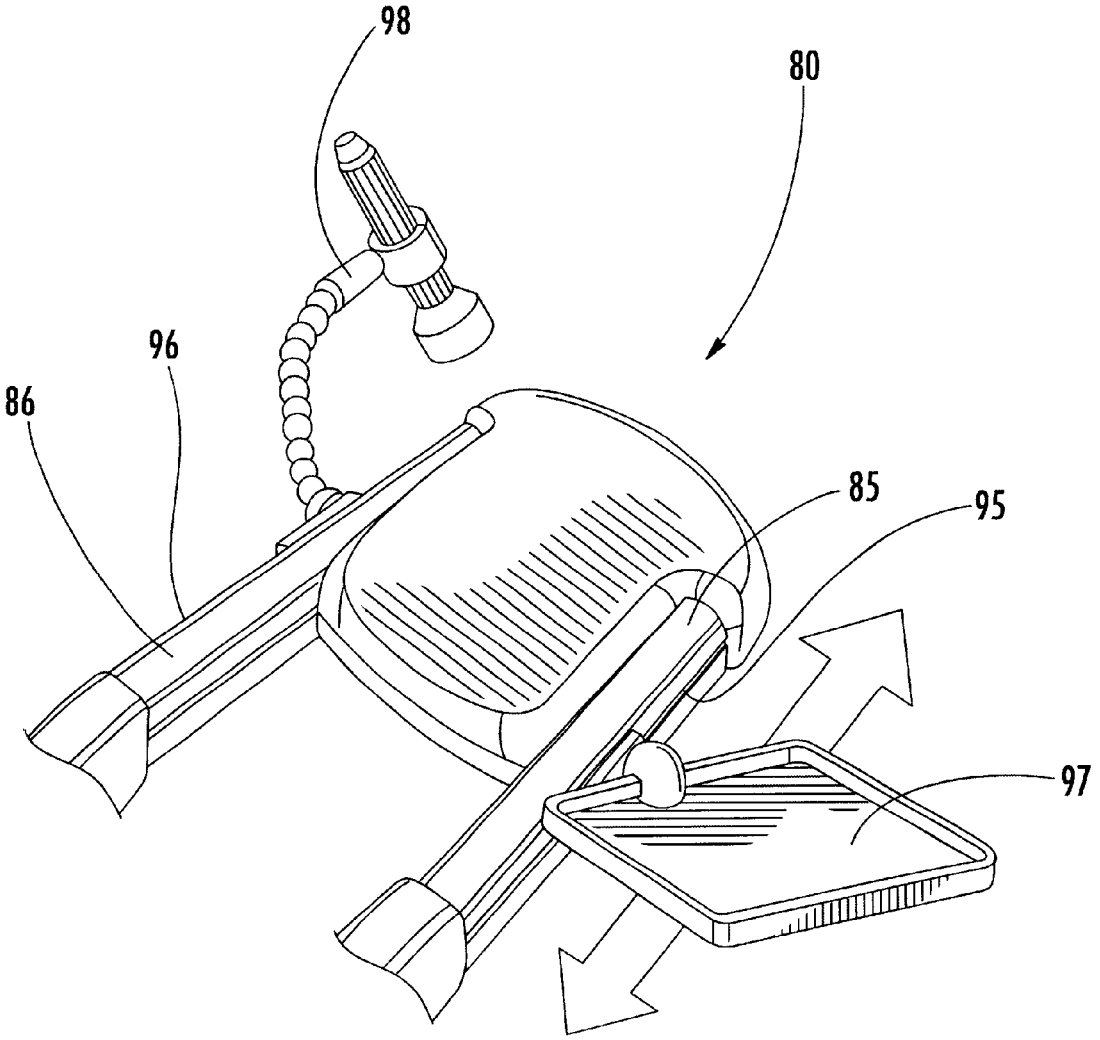
FIG. 10 is a fragmentary perspective view of the mechanic's body support shown in FIG. 9 and including flashlight and magnetic bolt tray attachments.

As is shown in FIG. 10, respective upper support rails 85 and 86 include respective grooves 95 and 96 (groove 96 is not shown) formed therein and extending along respective upper support rails 85 and 86, thereby permitting a bolt tray 97 and/or a flashlight 98 attached thereto to be moved up or down along the length of upper support rails 85 and 86, respectively.

Figure 11:
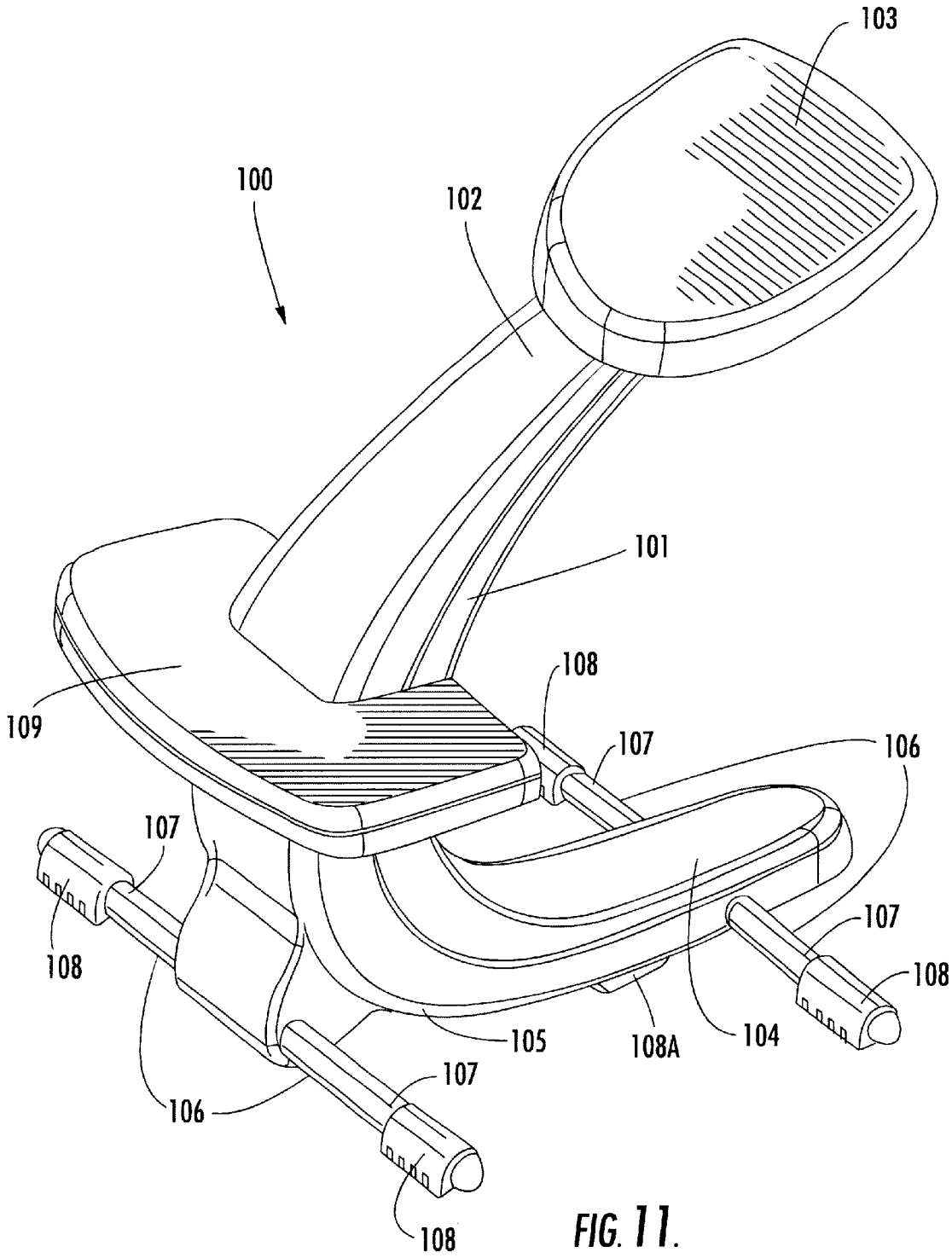
FIG. 11 perspective view of a mechanic's body support according to another embodiment of the invention.
Figure 12:
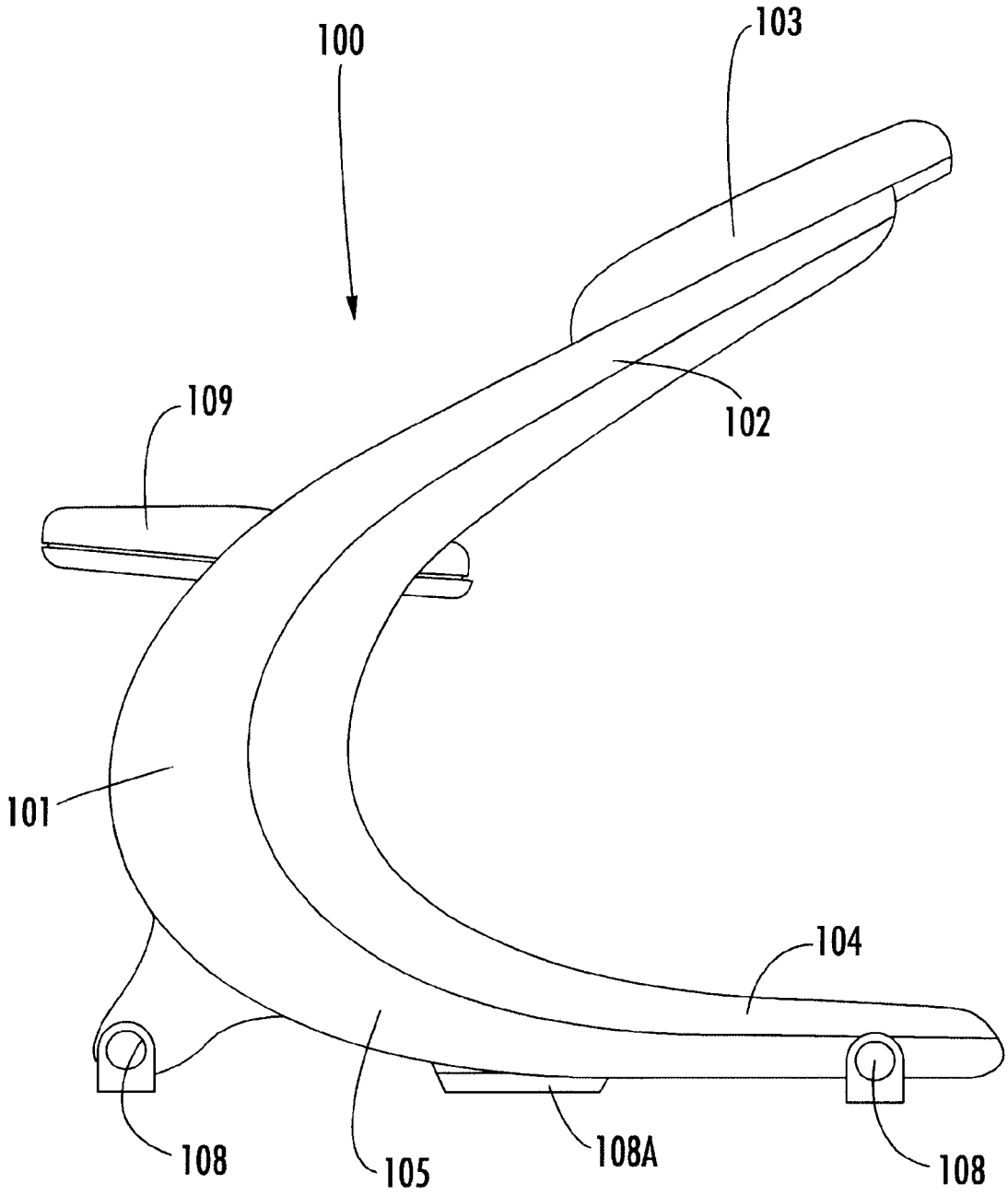
FIG. 12 is a elevation of the mechanic's body support shown in FIG. 11.

Referring now to FIG. 11, a mechanic's body support according to another preferred embodiment of the invention illustrated and shown generally at reference numeral 100. The body support 100 includes a curved support beam 101, which has an upper end 102 to which a chest pad 103 is attached for providing support to a mechanic's chest as he leans against the body support 100 to work on the engine of a motor vehicle, and a lower end 104 having an underside 105. A pair of laterally-extending feet 106 are positioned on underside 105 and extend therethrough for supporting the body support 100 in an upright position. Feet 105 include ends 107, each of which has a skid to proof handle 108 positioned thereon for preventing the support beam 101 from slipping or moving once it is positioned for use. An additional skid-proof foot 108A is attached to the underside 105. The body support 100 also includes a knee pad 109 positioned intermediate with the lower end 104 and knee pad 108 for supporting the knees of a mechanic kneeling thereon. A side view of the body support 100 is shown in FIG. 12.

Figure 13:
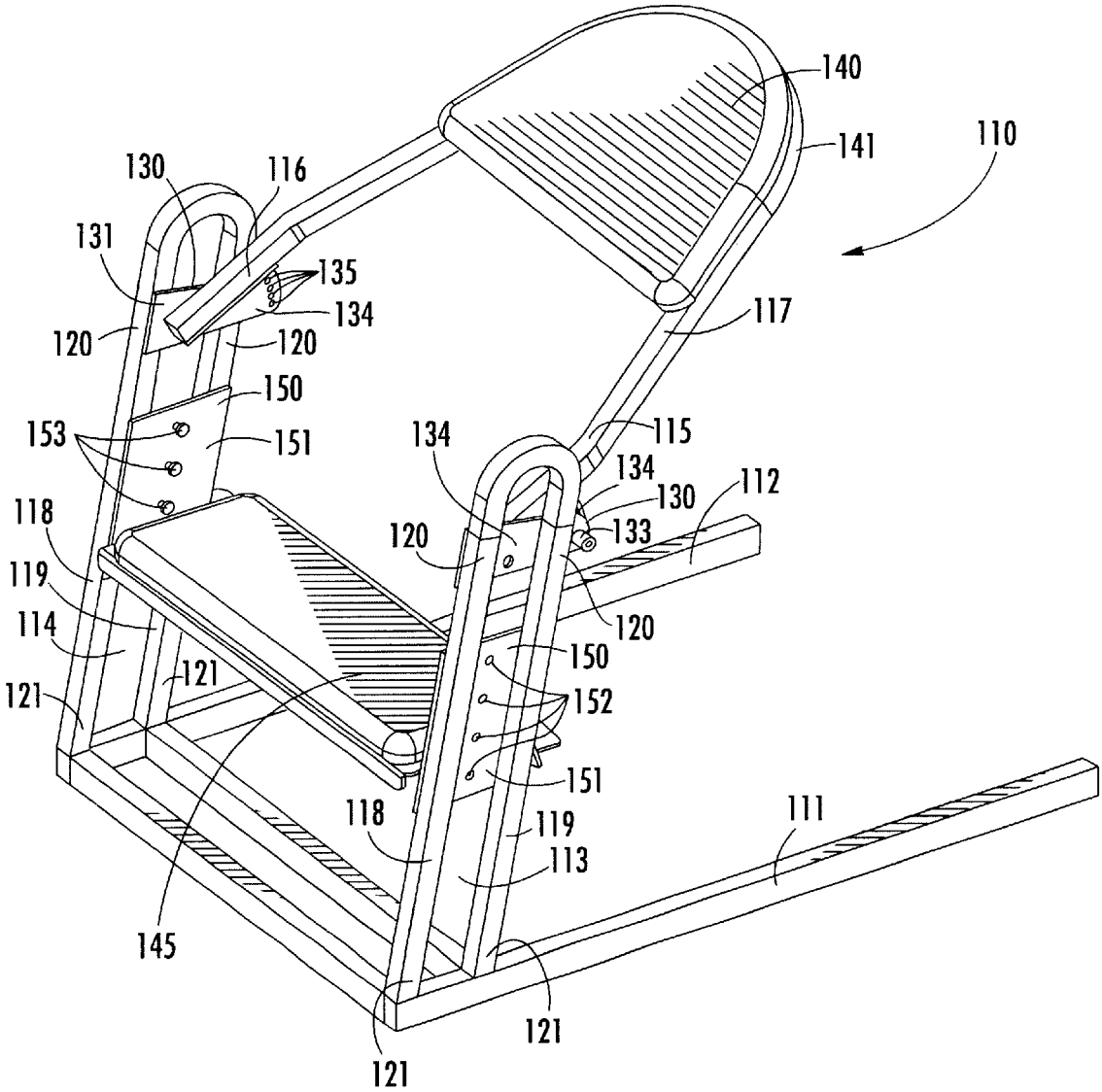
FIG. 13 is a perspective view of a mechanic's body support according to another embodiment of the invention.

Referring now to FIG. 13, a mechanic's body support according to another embodiment of the invention is illustrated and shown generally at reference numeral 110. Body support 110 includes first and second horizontally-oriented base rails 111 and 112 connected respective lower support rail sections 113 and 114. Two spaced-apart cross bars 111A and 112B are mounted between base rails 111 and 112 for providing supplemental reinforcement to the base support 110. Lower support rail sections 111 and 112 are attached to respective ends 115 and 116 of an upper support rail 117 by a pivot 130, which is discussed more fully below. Each respective lower support rail section 113 and 114 comprises respective first and second tubular rails 118 and 119. Each respective tubular rail 118 and 119 has respective first and second ends 120 and 121. The respective first ends 121 are connected to a respective one of the first and second base rails 111 and 112. The respective second ends 120 of the tubular rails 118 and 119 are connected together by one of two U-shaped tubular members 122.

Figure 14:
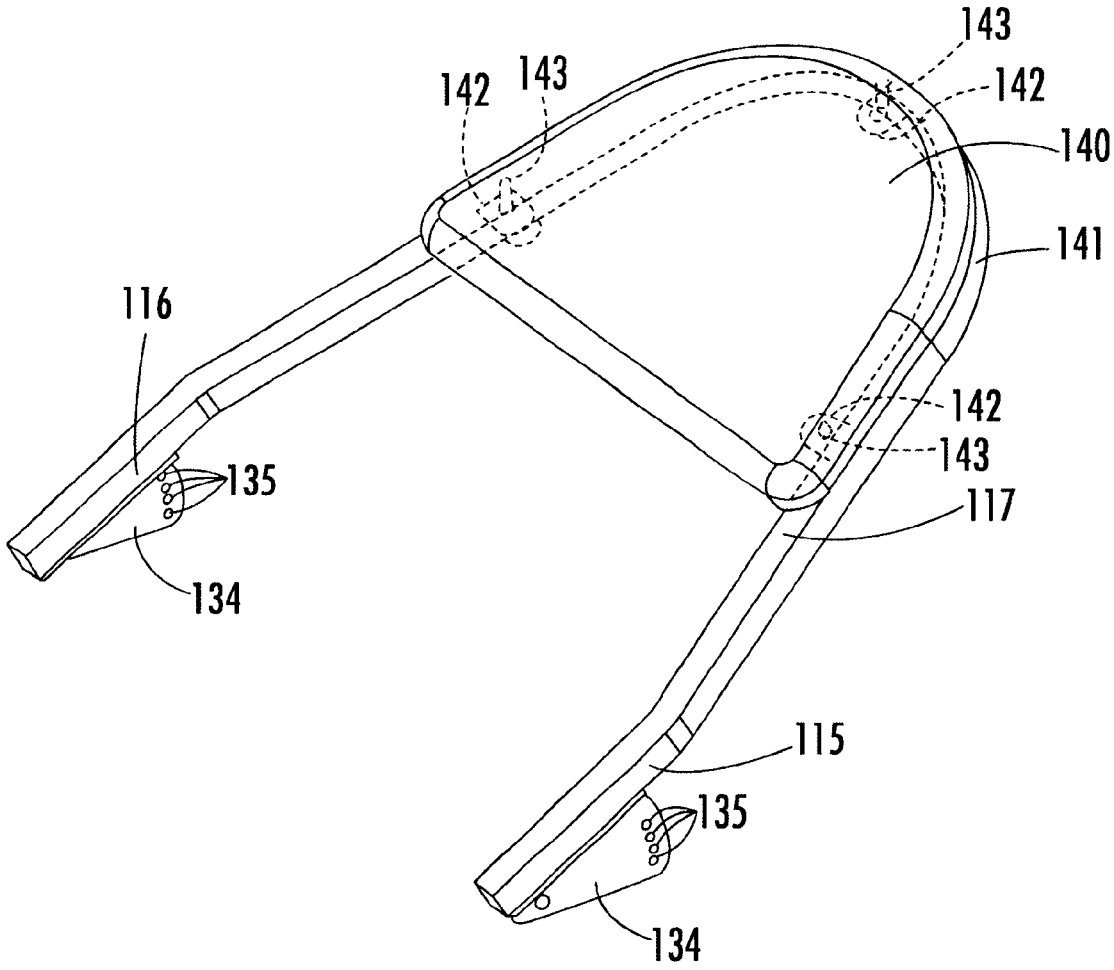
FIG. 14 is a perspective view of the chest support of the mechanic's body support shown in FIG. 13.

As shown in FIG. 13, each pivot 130 includes a plate 131 which is attached to the second ends 120 of one of the tubular support rails 118 and 119. The plate 131 includes a hole 132 therethrough (not shown), which is adapted for receiving a complementary locking pin 133. As is shown in FIG. 14, respective ends 115 and 116 each include an attached bracket 134 which includes holes 135 therein positioned at spaced-apart intervals along the edge of bracket 134. Each hole 135 is adapted for receiving the complementary locking pin 133 therethrough after the pin 133 has been inserted through the hole 132. Positioning the pin 133 through the holes 132 and 135 in this manner permits the upper support rail 117 to be moved through an arc for adjusting the pitch of a chest pad 140, which is positioned on upper support rail 117, as discussed more fully below.

Upper support rail 117 preferably comprises a U-shaped tubular rail section 141 upon which the chest pad 140 is mounted for supporting the chest of a mechanic as he leans thereon to work on the engine of a motor vehicle. Chest pad 140 is preferably mounted to the U-shaped tubular rail section 141 by three brackets 142. Each bracket 142 is attached to the inside of rail section 141 by a welded seam 144 (not shown) and is adapted for receiving a complementary screw 143 therethrough. FIG. 14 shows the brackets 142 and complementary screws 143 drawn in phantom. Each bracket 142 is preferably formed from a 7 gauge steel.sheet Referring again to FIG. 13, the body support 110 also includes a knee pad 145, which is attached between respective lower support rail segments 113 and 114 by two height-adjusting mechanisms 150. Each height adjusting mechanism 150 includes a rectangularly-shaped plate 151 connected between the first and second tubular rails 118 and 119, respectively. The plate 151 includes four holes 152 therethrough which are adapted for receiving complementary pins 153 for adjusting the vertical height of the knee pad 145. The height adjusting mechanisms 150 are for permitting pivotal movement of the knee pad 145 through an arc, and for locking the knee pad 145 in a limited number of predetermined angles relative to the lower support rail segments 113 and 114, respectively.

Figure 15:
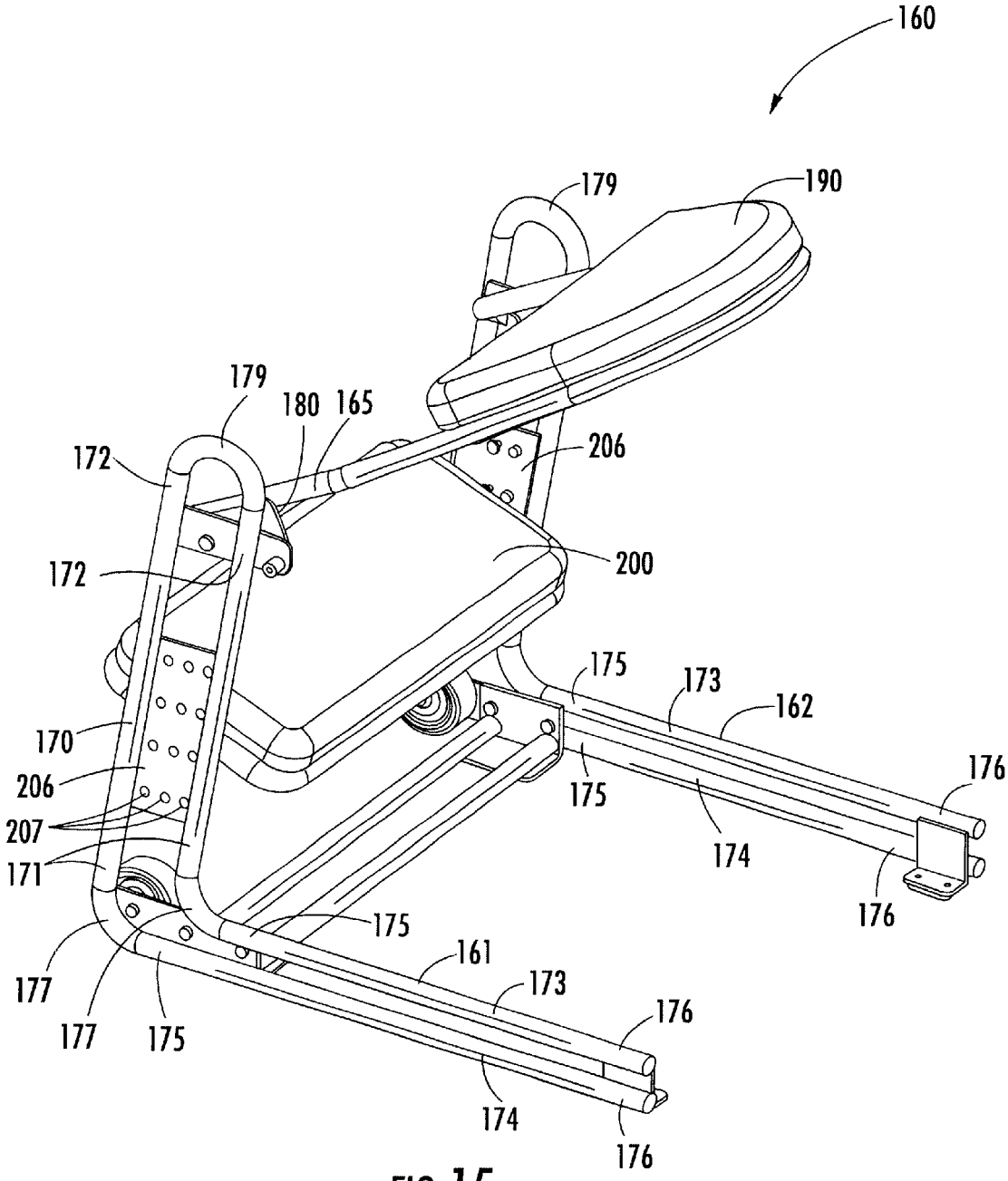
FIG. 15 is a rear perspective view of a mechanic's body support according to another embodiment of the invention.

Referring now to FIG. 15, a mechanic's body support according to the present invention is illustrated and shown generally at reference numeral 160. Body support 160 includes first and second horizontally-oriented base rails 161 and 162, which are connected to respective lower support rail sections 163 and 164. Lower support rail sections 163 and 164 are attached to respective ends 165 and 166 of an upper support rail 167 by a pivot 180, which is discussed more fully below. Lower support rail sections 163 and 164 each comprise respective first and second tubular rails 169 and 170. Tubular rails 169 and 170 each include respective first and second ends 171 and 172. Base rails 161 and 162 each comprise first and second base rail segments 173 and 174, each of which has respective ends 175 and 176. Each first end 171 is connected to a respective one of the ends 175 and 166 by a curved tube 177. Second ends 172 are connected together with one of two U-shaped tubular members 179.

Figure 16:
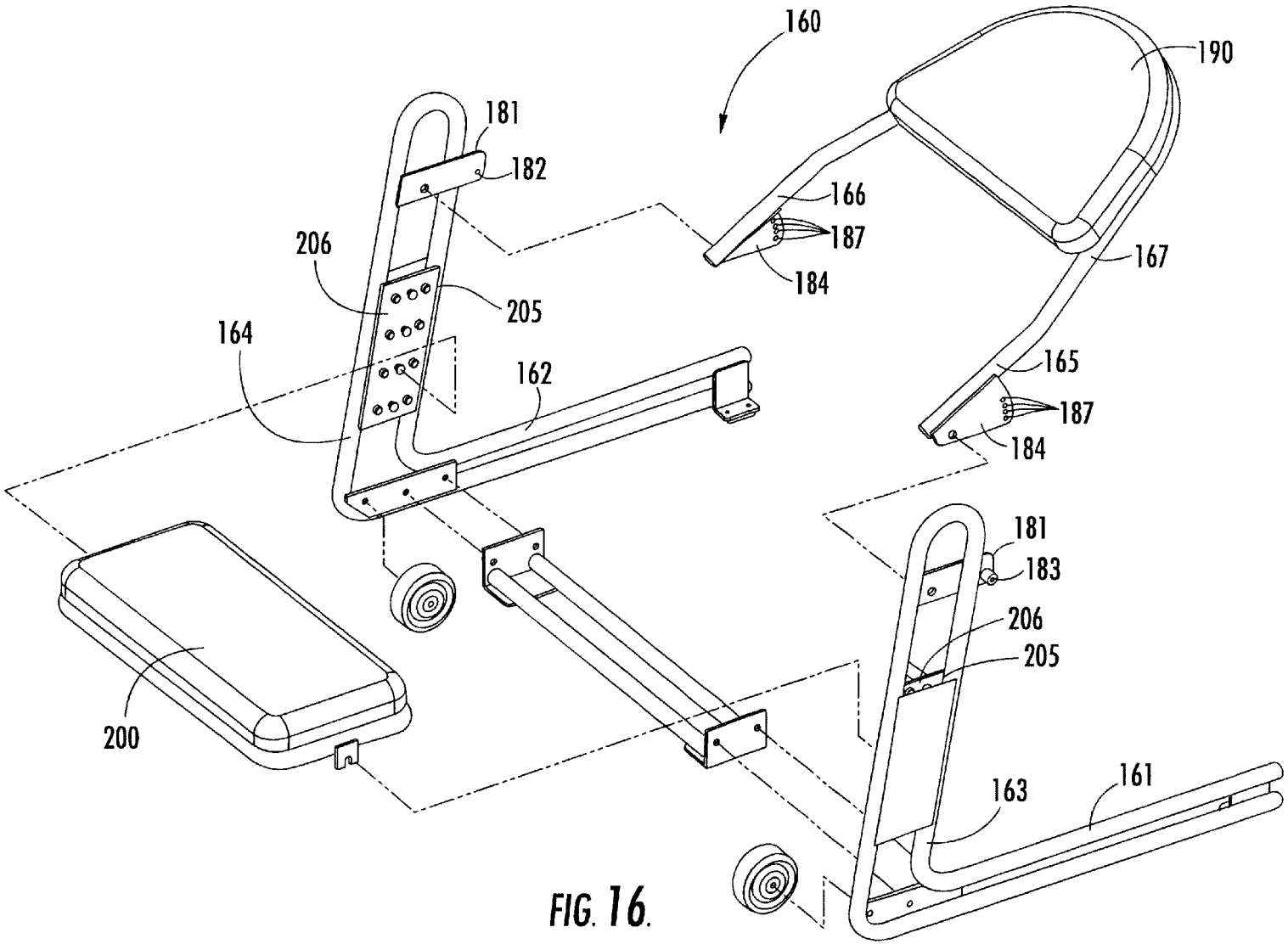
FIG. 16 is an exploded perspective view of the mechanic's body support shown in FIG. 16.
Figure 17:
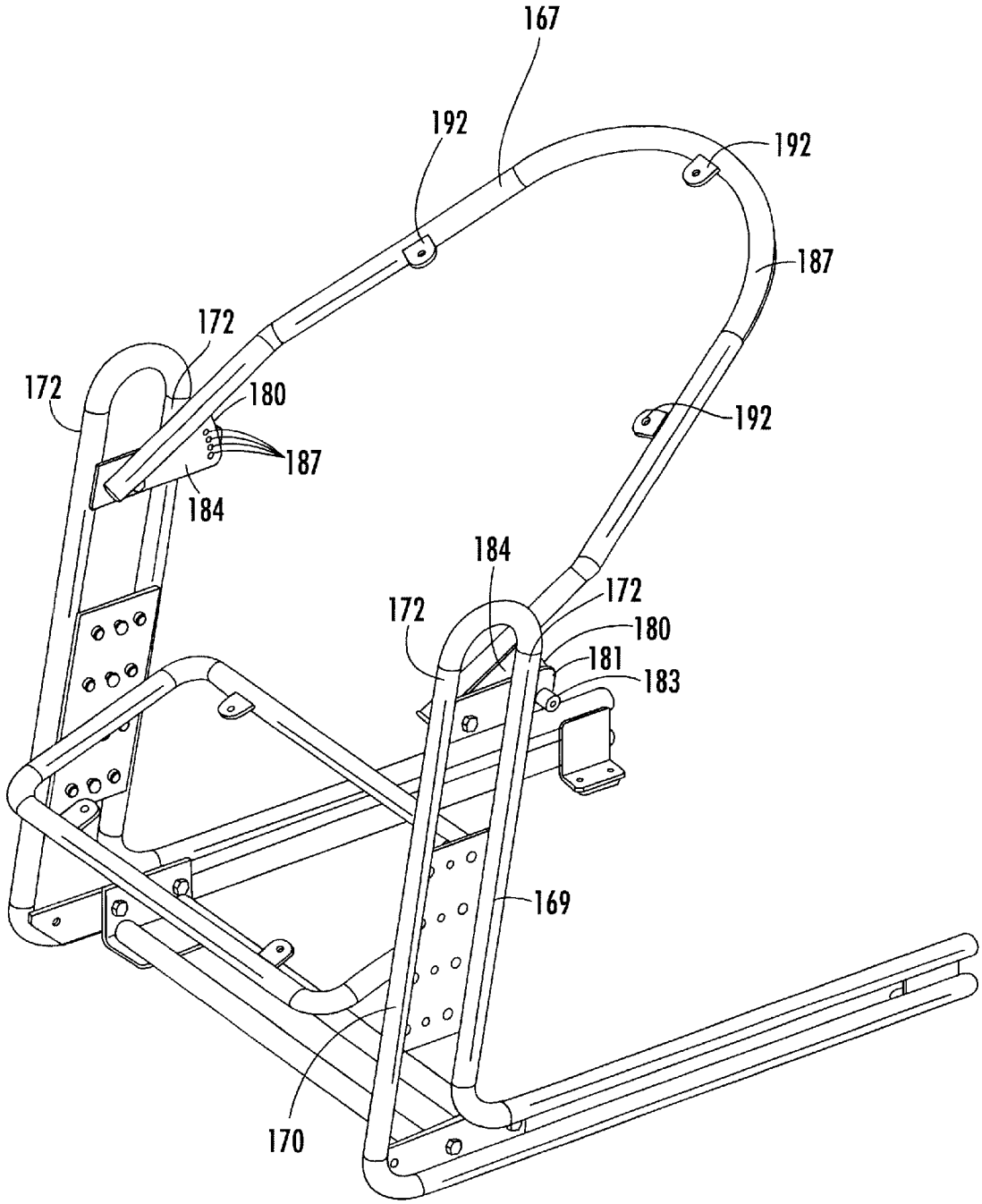
FIG. 17 is a perspective view of a mechanic's body support shown in FIG. 16 with the chest and knee pads removed for clarity.

As shown in FIGS. 16 and 17, each pivot 180 includes a plate 181 which is attached to the second ends 172 of one of the respective pairs of tubular support rails 169 and 170. The plate 181 includes a hole 182 defined therethrough, which is adapted for receiving a complementary locking pin 183 therethrough. A bracket 184 is attached to respective ends 185 and 186. The bracket 184 includes holes 187 positioned at spaced-apart intervals along the edge of bracket 184. Each hole 187 is adapted for receiving the complementary locking pin 183 therethrough after the pin 183 has been inserted through the first hole 182. Positioning the pin 153 through the respective holes 182 and 187 in this manner permits the upper support rail 167 to be moved through an arc for adjusting the pitch of a chest pad 190, which is positioned on the support rail 167 for supporting the chest of a mechanic as he leans thereon to work on the engine of a motor vehicle.

Referring now to FIG. 17, upper support rail 167 preferably comprises a U-shaped tubular rail section 187. Chest pad 190 is preferably mounted to the U-shaped tubular rail section 187 by three brackets 192, each of which is attached to the inside of rail section 187 and is adapted for receiving a complementary screw 194 therethrough (not shown). FIG. 17 shows the brackets 192 attached to the rail section 187.

Figure 18:
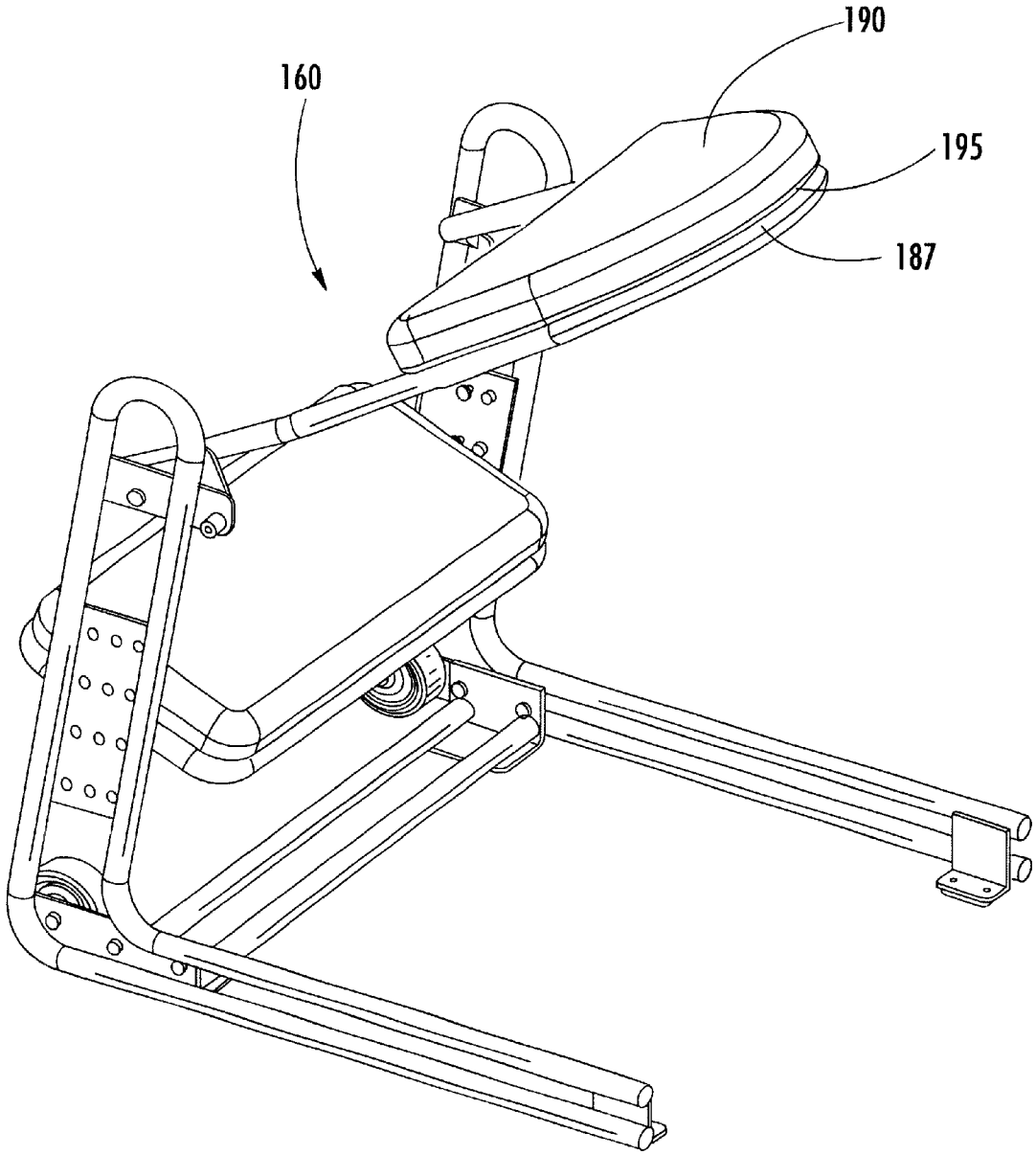
FIG. 18 is a front perspective view of the mechanic's body support shown in FIG. 16.
Figure 19:
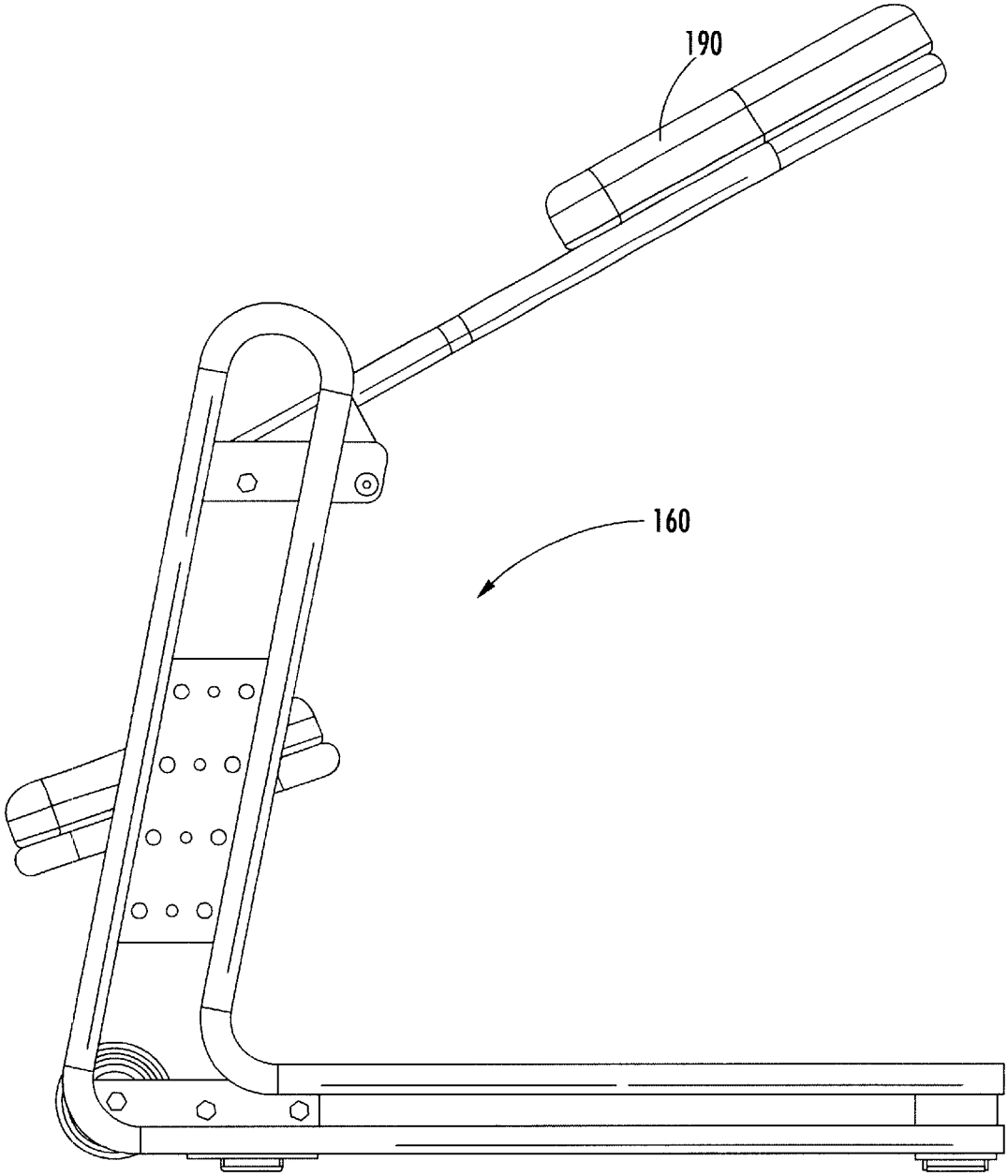
FIG. 19 is a side elevation of the mechanic's body support shown in FIGS. 16, 17 and 18.

Each bracket 192 is preferably formed from a 7 gauge steel sheet. As is shown in FIG. 18, chest pad 190 also includes a U-shaped channel 195 adapted for receiving rail section 187.

Referring again to FIG. 16, the body support 160 also includes a knee pad 200, which is attached between lower support rail segments 163 and 164 by two height-adjusting mechanisms 205. Each height-adjusting mechanism 205 includes a rectangularly-shaped plate 206 connected between each of the first and second tubular rails 169 and 170, respectively. As is shown in FIG. 20, the plate 206 includes twelve holes 207 therethrough which are adapted for receiving complementary pins 208. Height-adjusting mechanisms 205 are for adjusting the vertical height of the knee pad 200, for permitting pivotal movement of the knee pad 200 through an arc, and for locking the knee pad 200 in a limited number of predetermined angles relative to the lower support rail segments 163 and 164, respectively.

Body support 160 also includes first and second respective wheels 210 and 211, which are attached by respective brackets 212 and 213 to respective base rails 161 and 162. Two cross bars 214 are connected between the brackets 212 and 213 for providing reinforcement to the body support 160.

A body support for automotive mechanics is described above. Various details of the invention may be changed without departing from its scope. Furthermore, the foregoing description of the preferred embodiments of the invention and the best mode for practicing the invention are provided for the purpose of illustration only and not for the purpose of limitation—the invention being defined by the claims.

I claim:

1. A mechanic's body support, comprising:

(a) first and second horizontally-oriented and spaced-apart base rails;

(b) first and second spaced-apart support rails, each of said support rails having one end connected to a respective one of said first and second base rails and diverging upwardly from and along the length of the base rails for supporting a mechanic in an elevated position over an engine compartment of a motor vehicle;

(c) a pivotal knee pad mounted between the support rails for securing the support rails in a fixed, spaced-apart relation, and for supporting the knees of the mechanic; and (d) a chest pad connected to the support rails in spaced-apart relation to said knee pad for supporting the chest of the mechanic;

said support rails, chest pad, and knee pad collectively defining an unobstructed rear access area between the support rails and to the rear of the chest pad and knee pad for permitting unrestricted ingress and egress to and from said support and unrestrained movement of the mechanic while on the support.

2. A mechanic's body support according to claim 1, and including height adjustment means adapted for selectively mounting the knee pad in one of at least two vertical positions relative to the support rails.

3. A mechanic's body support according to claim 2, wherein said height adjustment means comprises first and second vertically-spaced notches, and the knee pad includes a complementary tooth thereon for cooperating with a respective one of said first and second notches.

4. A mechanic's body support according to claim 3, wherein said notch and complementary tooth are each shaped whereby the tooth is wedged into the notch in response to downward pressure on the knee pad.

5. A mechanic's body support according to claim 4, wherein each of said support rails is formed of at least two separable support rail segments and includes length adjusting means for permitting the length the support rail to be adjusted by movement of respective support rail segments relative to each other.

6. A mechanic's body support according to claim 5, wherein said length adjusting means comprise a keyway on one of said support rail segments, and a complementary post on the other of said support rail segments for cooperating with said keyway for releasably locking the two support rail segments together.

7. A mechanic's body support according to claim 2, wherein each of said support rails includes an upper rail segment and a lower rail segment, said upper rail segment rotatably connected to said lower rail segment by rotatable locking means for permitting limited movement of the upper rail segment through an arc for adjusting the pitch of the chest pad.

8. A mechanic's body support according to claim 7, wherein said rotatable locking means comprises a pair of releasably-locking hub gears.

9. A mechanic's body support according to claim 8, wherein said height adjustment means comprises a plurality of vertically-spaced openings defined by each support rail, each of said openings adapted for receiving and releasably locking a complementary slide on the knee pad therein, and the knee pad includes a complementary slide thereon for being received into a selected one of the openings.

10. A mechanic's body support according to claim 8, wherein said height adjustment means comprises a vertically-oriented slot extending through each of the support rails adapted for receiving a pin inserted therethrough, and a complementary hole defined in a side of the knee pad adapted for receiving said pin therein for releasably locking the knee pad into a selected one of a plurality of vertical positions.

11. A mechanic's body support according to claim 7, wherein said lower rail segment comprises first and second elongate tubular rails, each of said tubular rails having respective first and second ends, wherein the respective first ends of the first and second tubular rails are connected to a respective one of the first and second base rails and the respective second ends a of the first and second tubular rails are connected together by and integrally formed with a U-shaped tubular member.

12. A mechanic's body support according to claim 7, 10 or 11, wherein said chest pad includes a U-shaped channel adapted for receiving a U-shaped tubular rail therein, and the upper rail segment comprises a complementary U-shaped tubular rail for cooperating with said U-shaped channel for attaching the knee pad to the upper rail segment.

13. A mechanic's body support according to claim 12, wherein said rotatable locking means comprises:

(a) a first plate connected between the first and second tubular rails and having a first hole defined therethrough;

(b) a second plate connected to the upper rail segment and having a series of second holes defined therethrough at spaced-apart intervals to form an arc; and (c) and a locking pin adapted for being inserted through said first hole, and then through a selected one of said second holes and into a opening defined in an end of the U-shaped tubular rail.

14. A mechanic's body support according to claim 13, wherein said height adjusting means includes pivot means comprising a third plate connected between the first and second tubular rails, said third plate adapted for permitting limited pivotal movement of the knee pad through an arc and locking the knee pad in a limited number of predetermined positions, thereby adjusting the angle of the knee pad relative to the support rails.

15. A mechanic's body support according to claim 14, and including first and second wheels positioned on the respective first and second base rails for permitting said body support to roll as it is being moved.

* * * * *